US006224503B1

(12) United States Patent
Joseph

(10) Patent No.: US 6,224,503 B1
(45) Date of Patent: May 1, 2001

(54) PORTABLE BASKETBALL RETRIEVAL AND RETURN DEVICE

(76) Inventor: John Gibson Joseph, 3305 C.H. 47, Upper Sandusky, OH (US) 43351

( * ) Notice: Subject to any disclaimer, the term of this patent is extended or adjusted under 35 U.S.C. 154(b) by 0 days.

(21) Appl. No.: 09/365,252

(22) Filed: Jul. 30, 1999

(51) Int. Cl.[7] ..... A63B 69/00

(52) U.S. Cl. ..... 473/422; 473/436; 473/447; 124/6

(58) Field of Search ..... 124/6; 473/421, 473/422, 431, 433, 436, 447, FOR 101, FOR 103

(56) References Cited

U.S. PATENT DOCUMENTS

| | | | |
|---|---|---|---|
| 1,223,386 | * | 4/1917 | Handelan . |
| 2,908,266 | * | 10/1959 | Cooper . |
| 3,878,828 | * | 4/1975 | Francesco . |
| 4,168,695 | * | 9/1979 | Haller et al. . |
| 4,262,648 | * | 4/1981 | Wegener et al. . |
| 4,471,746 | * | 9/1984 | Ando . |
| 5,393,049 | | 2/1995 | Nelson . |
| 5,409,211 | | 4/1995 | Adamek . |
| 5,417,196 | | 5/1995 | Morrison et al. . |
| 5,681,230 | | 10/1997 | Krings . |
| 5,746,668 | | 5/1998 | Ochs . |
| 5,771,018 | | 7/1998 | Simpson et al. . |
| 5,813,926 | | 9/1998 | Vance . |
| 5,842,699 | | 12/1998 | Mirando et al. . |

* cited by examiner

*Primary Examiner*—William M. Pierce
(74) *Attorney, Agent, or Firm*—George C. Atwell

(57) ABSTRACT

A portable basketball retrieval and return device includes a movable support platform having casters for allowing the positioning of the device on a playing surface adjacent a basketball backboard and rim, a slidable upright frame mounted to the platform and to which a plurality of telescoping arms are attached whereby both the frame and arms are selectively extensible and retractable for disposing netting material which collects shot basketballs from the basketball backboard and rim. In order to eject basketballs in varying directions and velocities, and within various selected time intervals, to players dispersed about the playing surface, the device includes a catapult arm that receives basketballs and pivots between cocked and ejection positions for throwing the basketballs, a cam powered by a main thrower motor for rotating a loading wheel whose rotation lowers the catapult arm to the cocked position and a selectively pivotable positioner plate upon which the drive motor, the catapult arm, the cam, and the wheel are mounted. The device also includes an electronic control system whereby the practicing player can set the ejection points during pivotable motion of the positioner plate, the distance and velocity for the ejected basketballs, and the time interval between successive basketball ejections.

13 Claims, 8 Drawing Sheets

FIG. 4
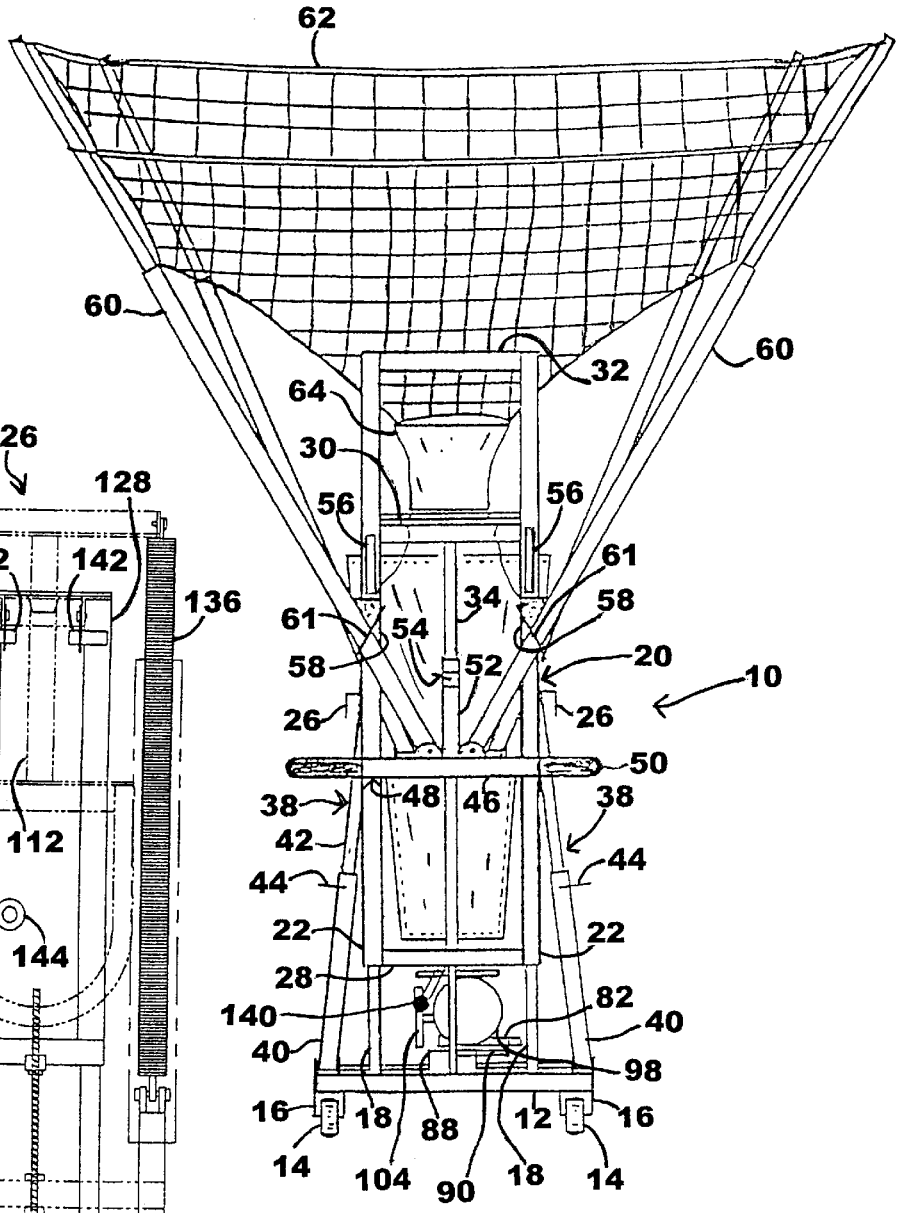
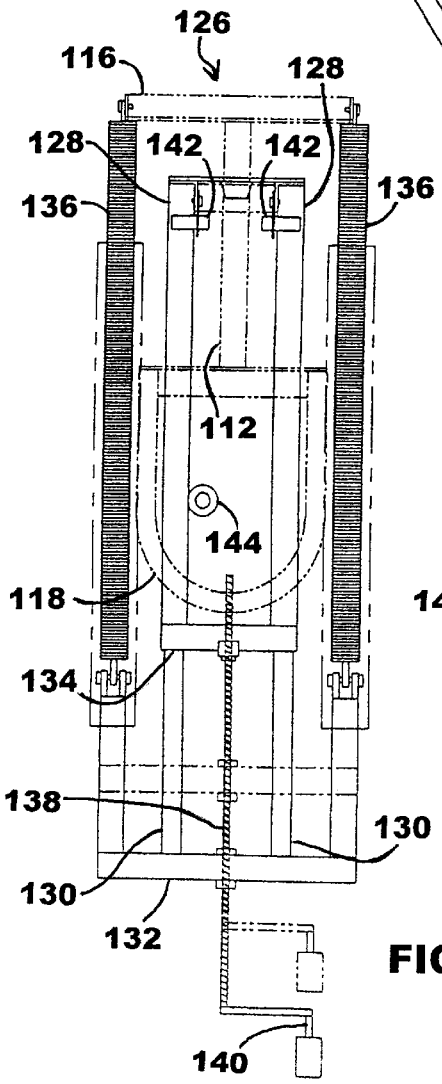
FIG. 5

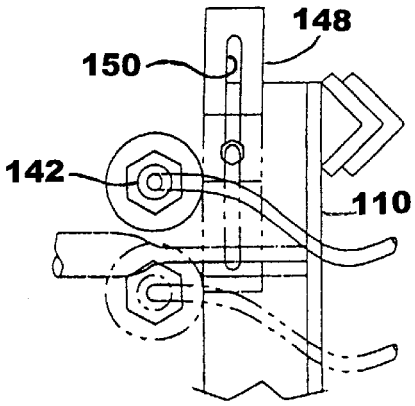
FIG. 13
FIG. 12
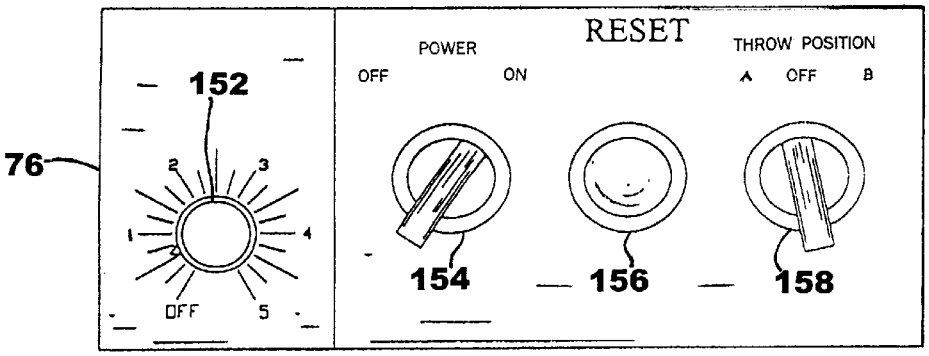
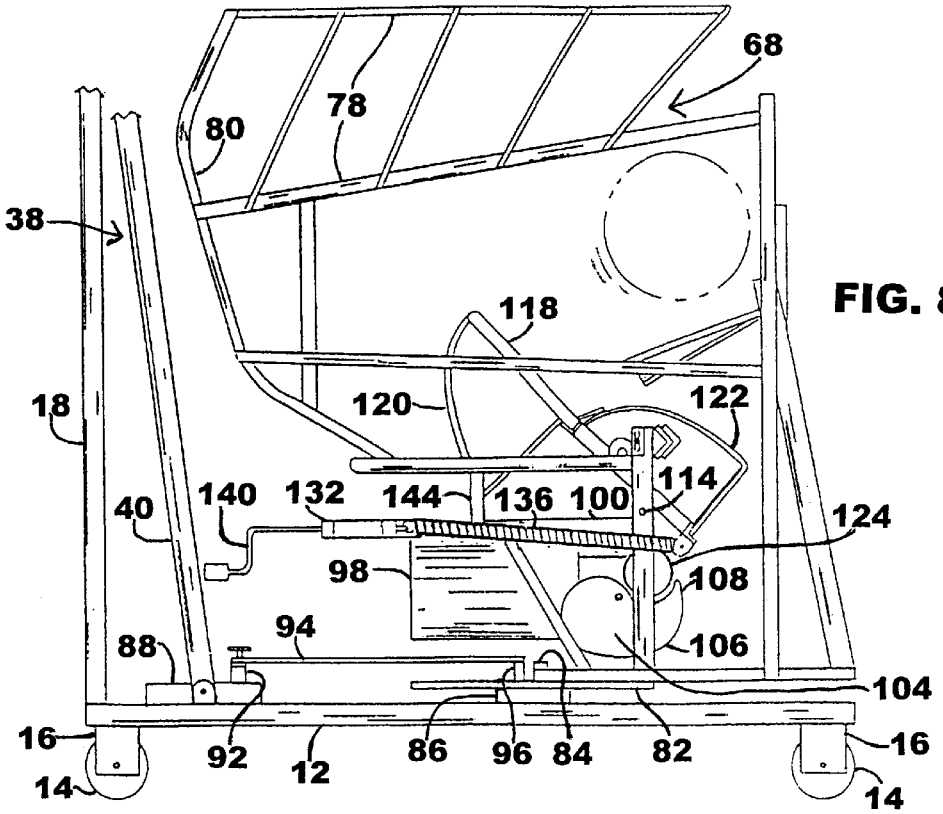
FIG. 8

FIG. 14
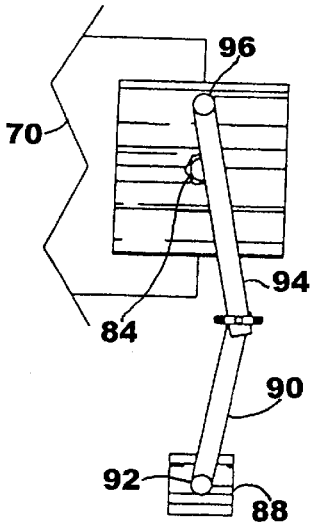
FIG. 15
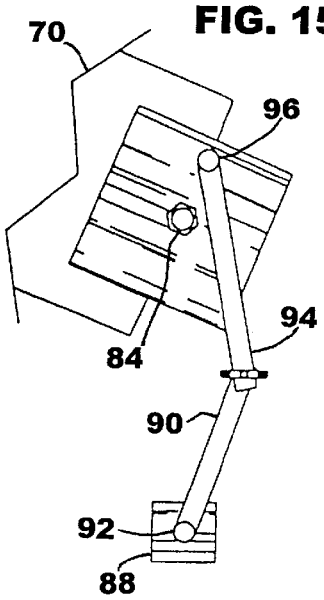
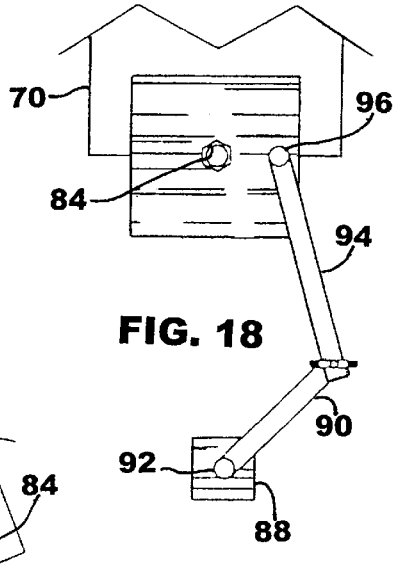
FIG. 18
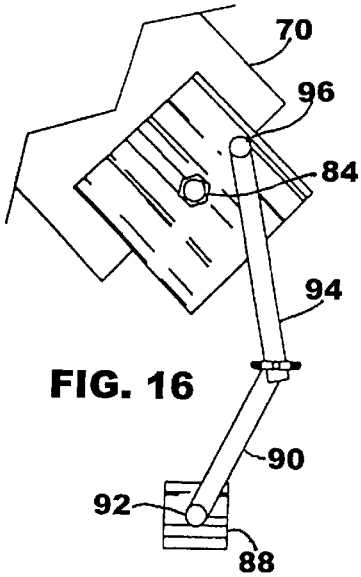
FIG. 16
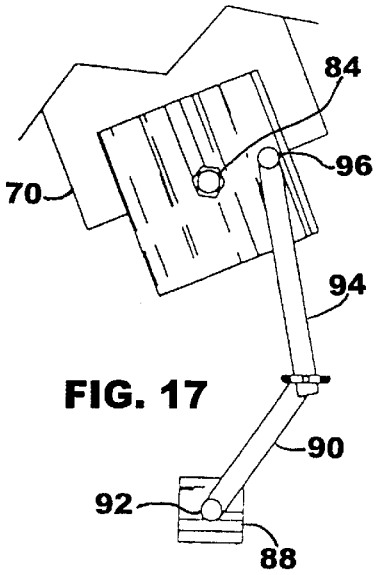
FIG. 17

PORTABLE BASKETBALL RETRIEVAL AND RETURN DEVICE

FIELD OF THE INVENTION

The present invention relates to devices for collecting and returning shot or thrown balls to individuals dispersed about the device, and, more particularly, relates to a collection and automatic return device for returning a succession of shot basketballs to practicing players dispersed about a playing surface in stationary locations or moving thereon to different locations and in the process receiving the ejected basketballs and then shooting them at a pole or wall-supported backboard and rim positioned above the device.

In sports or athletic activities which require a player or players to throw a ball, such as a baseball or basketball, at a target or which requires the player or players to hit, strike or receive a thrown or pitched ball, it is extremely advantageous for the players involved to have the means to practice such motions and movements in a constant, repetitive manner to thereby improve and sharpen their skills. When a number of players are available for a particular practice session, one or several players can shoot the basketball at the rim attached to a basketball backboard which itself is either pole-supported or wall-supported, while the remaining players cover the court in order to chase down, retrieve, and then subsequently return the errantly shot basketballs to the practicing player or players. The practicing player or players will certainly not maximize their practice time when they are limited to manually chasing down and retrieving errantly shot basketballs, and more time may be spent chasing down basketballs that have unpredictably ricocheted off the rim, backboard, and the wall (if the backboard is wall-supported) than will have actually been spent in practice shooting. Moreover, should the practicing players wish to incorporate sophisticated movements, set plays, and half-court or full court tactics, which would require the practicing players to weave, sprint, dribble, pass, and shoot while continuously moving about the playing surface constantly receiving shot basketballs that have either passed through the rim or that have rebounded and must be chased down and collected, it is simply inadequate and impractical to have a single player stand directly beneath the rim and feed basketballs to various locations about the playing surface as the basketballs fall through the rim. Therefore, in view of the fact that the skills of basketball players are improved by continuous and repetitive practice, and the elimination of dead time involved in chasing, retrieving, collecting, and delivering the basketballs to practicing players obviously increases the amount of valuable practice time available for the players, the sports, games, and amusements fields have developed numerous systems and devices to continuously collect and deliver balls of all sorts, including basketballs, to practicing players whereupon the players can repetitively throw or shoot the balls at some type of target, such as the rim of a basketball backboard. Thus, both the intensity of the practice session and the amount of real practice time are increased for the mutual benefit of each player as well as the team.

DESCRIPTION OF THE PRIOR ART

The prior art discloses a number of devices which return a succession of balls to a player or players stationed within the throwing range of the respective device.

U.S. Pat. No. 5,393,049 (Nelson) discloses a frame structure secured to the backboard for guiding basketballs to a bendable tubular member whereupon the basketballs traverse the tubular member and exit therefrom to a waiting player.

U.S. Pat. No. 5,409,211 (Adamek) discloses a basketball return device which is mounted to the basketball rim and includes a curvilinear basketball return chute which returns basketballs to the practicing shooter.

U.S. Pat. No. 5,417,196 (Morrison et al.) discloses an automatic ball projection device which uses a net to collect the basketballs and a continuously rotating drive wheel and drive belt to physically eject basketballs from the device's chute section.

U.S. Pat. No. 5,681,230 (Krings) discloses an automatic ball return apparatus which ejects basketballs by using a T-shaped ejector arm propelled by elastic bands. The ejector arm is mounted to a pivotable shaft whereby remote signals can be sent to the controller for altering the direction from which or to which the basketballs are ejected.

U.S. Pat. No. 5,746,668 (Ochs) discloses a basketball retrieval apparatus and shooting system which includes a curvilinear, elongated, pivotable ramp which is attached at one end to a funnel-shaped basketball collection mechanism attached to the basketball backboard, and has an opposite end terminating at an upright stand, whereupon basketballs roll down the curvilinear ramp to a practicing player standing adjacent the upright stand.

U.S. Pat. No. 5,776,018 (Simpson et al.) discloses a basketball collection, passing, and shot analysis system which ejects basketballs that have passed through the rim or have been collected by a collection net assembly to practicing players by passing the basketballs by a pair of spaced-apart passing rollers, with one passing roller spaced from and above the second passing roller in order to allow basketballs to travel therebetween for ejection therefrom.

U.S. Pat. No. 5,813,926 (Vance) discloses a basketball free-throw training apparatus which includes a framework disposed in front of and generally above the height of the basketball rim whereby the practicing player must attain the proper basketball trajectory in order to shoot the basketball over the framework and then into and through the rim attached to the basketball backboard.

U.S. Pat. No. 5,842,699 (Mirando et al.) discloses a basketball game apparatus which includes a plurality of vertically-aligned basketball rims with the medial basketball rim capable of selective displacement from the vertical alignment of the other two basketball rims so that the practicing individual must time his or her shot at just the appropriate moment to allow the shot basketball to fall through all three basketball rims when they are in their vertical alignment.

SUMMARY OF THE INVENTION

The present invention comprehends basketball return devices, and, more particularly, comprehends a portable basketball retrieval and return device positionable on a playing surface for collecting and then ejecting shot basketballs with varying velocities and distances, and at various time intervals, to either stationary or moving players dispersed about the playing surface.

The basketball retrieval and return device includes a support platform having casters for positioning and repositioning the device on the playing surface. A rectangular-shaped slidable frame is mounted to the rear of the support platform and is capable of slidable, upward movement toward a basketball backboard and rim attached thereto, and downward toward the support platform for selectively extending and retracting a plurality of netting support arms to which flexible netting material is attached for collecting shot basketballs and directing the basketballs to structural elements which successively eject the basketballs to practicing players.

The structural elements which receive, guide, and throw the basketballs are mounted to the support platform and are enclosed within a protective cover. Attached adjacent to the lower funnel-shaped opening of the netting material is a basketball funnel member through which basketballs pass whereupon the basketballs are successively directed downwardly along a basketball guide bars whereupon one basketball at a time rests on the seating ring of a pivotable catapult arm that is in the cocked positsion. The catapult arm pivots between a cocked position and a throwing position, and when in the cocked position the catapult arm is held under tension applied by a pair of throwing springs that have one end attached to the catapult arm and their opposite ends attached to a rectangular-shaped spring mounting and adjustment frame. A wheel is mounted to the underside of the catapult arm, and is rotated by an eccentrically-mounted cam drivingly connected to a main thrower motor by a main drive shaft. An electronic control system which includes one photoelectric eye and two proximity switches registers the seating of one basketball on the seating ring of the catapult arm, the throwing of basketballs, one at a time, by the catapult arm, and the time interval between throws for cocking the catapult arm. The wheel, the cam, the catapult arm, the springs, and the adjustment frame are all mounted on a basketball distribution and positioner plate that is mounted to the platform and pivots on a vertical axis with respect to the platform. A manual control panel mounted on the cover allows the practicing players to select the time interval between successive ejections of basketballs, and whether the basketballs are ejected throughout a continuous 180° arc within which the positioner plate rotates, at a number of selected points within the arc, or in a fixed direction determined by the pointing the device at a particular point or area on the playing surface.

In addition, the device includes a secondary positioner motor that is connected by a linkage to the positioner plate which rotates in a specific manner the positioner plate as a result of the players selecting a particular setting on the control panel. The secondary positioner motor is electrically connected to one of a plurality of proximity switches and is operative when the control panel is set for continuous fanning and basketball ejection at selected points within the arc; the secondary positioner motor is non-operative when the control panel is set for stationary basketball ejection in a fixed direction.

It is an objective of the present invention to provide a portable basketball retrieval and return device which is portable for positioning and repositioning on a playing surface and capable of easy set-up and storage.

It is another objective of the present invention to provide a portable basketball retrieval and return device which allows practicing players to vary the distance, velocity, and direction of the succession of ejected basketballs.

Yet another objective of the present invention is to provide a portable basketball retrieval and return device which allows players to select the time interval between successive basketball ejections so that players can move to different positions on the playing surface and thereby incorporate basketball drills with the use of the device.

These and other objects, features, and characteristics of the present invention are better understood from the following detailed description of the preferred embodiment when read in conjunction with the appended drawing figures.

BRIEF DESCRIPTION OF THE DRAWINGS

FIG. 4 is a rear elevational view of the device first shown in FIG. 2 wherein the netting support arms and the netting material are fully extended so that the device is ready for use;

FIG. 5 is a top plan view of the spring mounting and adjustment frame and illustrates the selective tightening or releasing of tension upon the springs which alters the distances and velocities that basketballs are ejected from the device;

FIG. 8 is a side elevational view of the device first shown in FIG. 6 wherein the catapult arm has pivoted for ejecting the basketball therefrom;

FIG. 12 is a front elevational view of the control panel first shown in FIG. 1 mounted to one side of the protective cover for the device;

FIG. 13 is a side elevational fragmentary view of the adjustable mounting structure for one proximity switch;

FIG. 14 is a top plan schematic view illustrating the pivotable movement of the basketball distribution and positioner plate by the linkage and positioner motor whereby the basketball distribution and positioner plate has pivoted to a position lateral and 90° to the longitudinal axis of the support platform;

FIG. 15 is a top plan schematic view illustrating the next position to which the positioner plate has pivoted along its arc of rotation;

FIG. 16 illustrates the third position to which the positioner plate has pivoted as it rotates throughout the 180° arc or semicircle of rotation;

FIG. 17 shows the fourth position to which the positioner plate has pivoted as it continues moving to selected points throughout the arc of rotation; and FIG. 18 shows the positioner plate pivoted 90° from the position shown in FIG. 14 whereby the positioner plate and all the mechanical and electrical elements and structure mounted on the positioner plate are now aligned with the longitudinal axis of the support platform.

DETAILED DESCRIPTION OF THE PREFERRED EMBODIMENT

Figure 1:
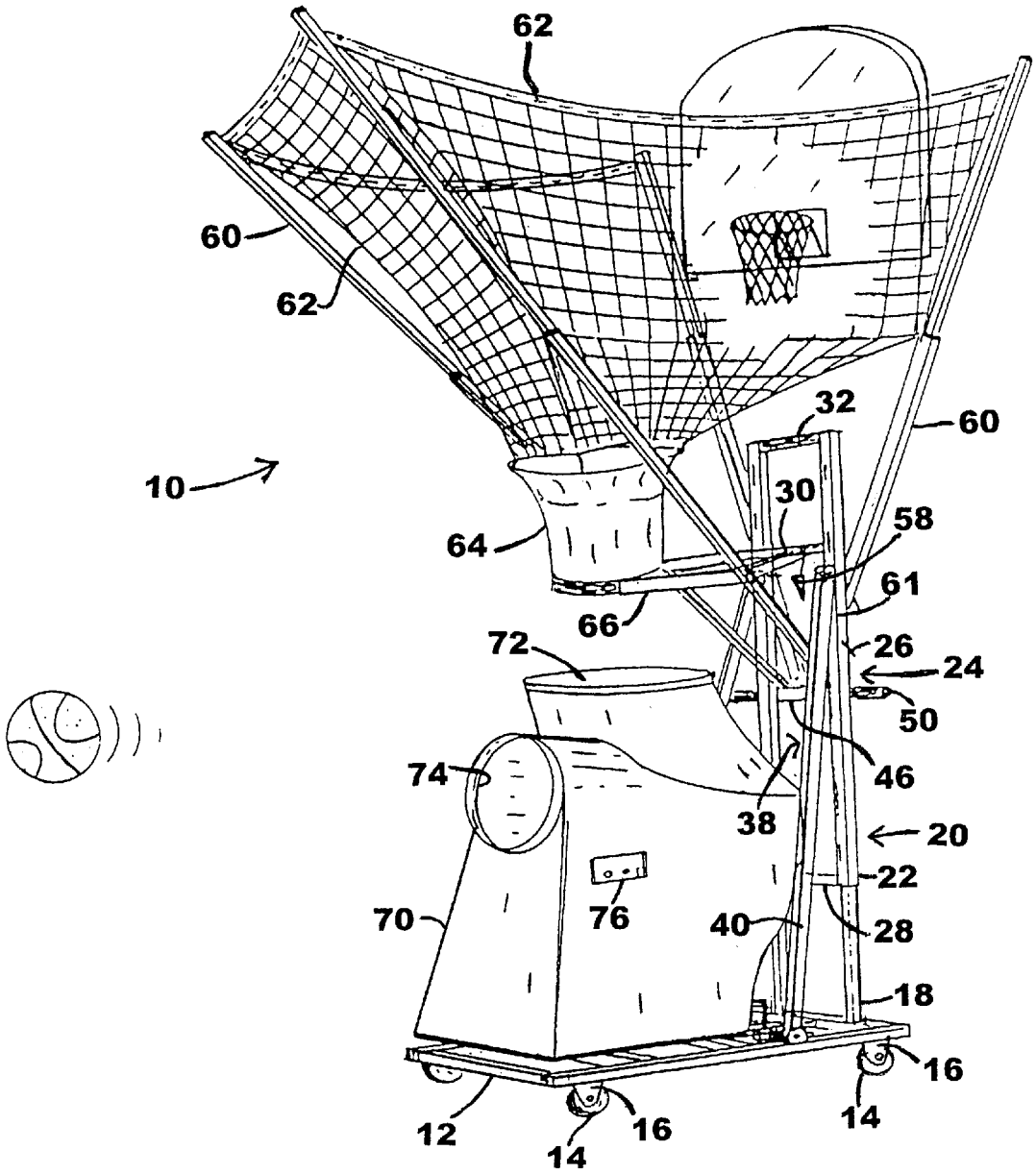
FIG. 1 is a perspective view of the basketball retrieval and return device set up for use on a playing surface.

Illustrated in FIGS. 1–18 is a movable and portable basketball retrieval and return device 10 for disposition on a playing surface, such as the hardwood floor of an indoor basketball court or the blacktop surface of an outdoor basketball court. The device 10 can be used in conjunction with a pole-supported basketball backboard and rim or a wall-supported basketball backboard and rim. The device 10 returns a succession of shot basket-balls to players dispersed on the playing surface and which may be stationary or moving with respect to the device 10. Thus, the device 10 of the present invention functions as much more than a device for merely improving a players free-throw shooting ability from a static position directly in front of the device 10. Basketball drills of college and professional level complexity can thereby be incorporated with the use of the present device 10.

As shown in FIGS. 1–4 and 6–9, the device 10 includes a base or support platform 12 which rides on a plurality of casters 14 spaced on and mounted to the underside of the support platform 12. The casters 14 allow the device 10 to be positioned and then repositioned on any playing surface for optimum use by the practicing players. Each caster 14 includes a metal framework 16 secured to the underside of the support platform 12 and within which one caster 14 is mounted. The support platform 12 also defines a front and a rear, with the front of the platform 12 being that portion closest to the shooting player and from which basketballs are ejected, and the rear of the platform 12 being that portion farthest from the shooting player and closest to the backboard and rim.

Figure 2:
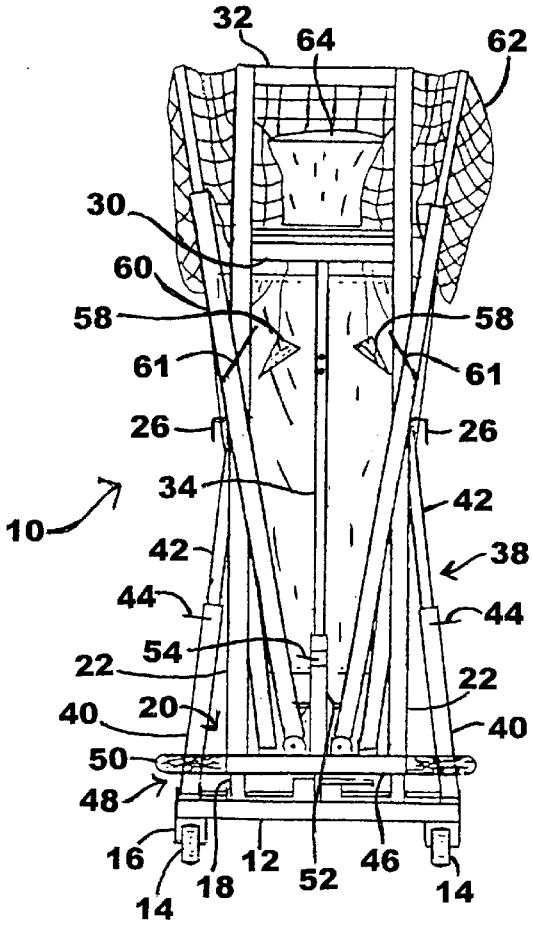
FIG. 2 is a rear elevational view of the device first shown in FIG. 1, showing the device in its collapsed or non-use disposition.

Illustrated in FIGS. 1–4 and 6–8 are a pair of spaced-apart framework support posts 18 which are mounted to the rear of the platform 12 and extend upwardly therefrom. A generally rectangular-shaped, slidable netting and arm support frame 20 is mounted on the framework posts 18 and is capable of selective linear reciprocable movement thereon and coplanar therewith upwardly toward the basketball backboard and rim and downward toward the support platform 12. The frame 20 comprises two vertically-extending tubular members 22, with each tubular member 22 mounted on each respective support post 18 for slidable telescoping movement thereon. Each tubular member 22 includes a locking means for locking the entire frame 20 in place on the support posts 18 once the frame 20 has been appropriately positioned. The locking means includes a pair of locking bolts 26, with one bolt 26 threaded into each tubular member 22 so that each bolt 26 can be tightened against the respective surfaces of each support post 18 thereby fixing the frame 20 in position on the support posts 18. The frame 20 also includes a lower horizontal bar 28 which extends between and is mounted to the lowest portion of each tubular member 22, a middle horizontal bar 30 which extends between and is secured to each respective tubular member 22 approximately one-half to two-thirds of the way up on the tubular members 22, and an upper horizontally-extending bar 32 which extends between and is attached to the uppermost portion of each tubular member 22. All three bars 28, 30, and 32 are part of the frame 20 and, thus, move up or down with the frame 20 during the positioning of the frame 20 on the support posts 18. In addition, a middle, vertically-extending handle tracking bar 34 extends between and has its opposite ends secured to the bar 28 and the bar 30 and, thus, also travels with the frame 20. A second handle tracking bar (not shown) can also be included for use in conjunction with the frame 20, and the second handle tracking bar will be stationarily mounted to the support platform 12 adjacent, parallel, and immediately in front of the bar 34. The second handle tracking bar would vertically extend parallel with bar 34 at least to the same height as the frame 20 when the frame 20 is in the collapsed or down position as shown in FIG. 2. The bar 34 has several apertures 36 spaced thereon adjacent the upper end of the bar 34.

In order to provide additional support for the frame 20 in its vertical orientation with respect to the platform 12, a pair of stanchions 38, as shown in FIGS. 1–4 and 6–8 are used, and each stanchion 38 includes an outer tubular member 40 pivotably mounted to one side of the platform 12 and an inner tubular member 42 which is pivotably mounted to each respective tubular member 22 approximately two-thirds of the way up on the members 22. The tubular members 42 telescope within the tubular members 40 so that the frame 20 can achieve more height and the slidable telescoping movement of the tubular members 42 within the tubular members 40 is coincident with the slidable telescoping movement of both tubular members 22 on the framework support posts 18. Each tubular member 40 has a locking key or bolt 44 threaded through its respective body so that the practicing player can loosen the bolt 44 for permitting the slidable movement of the tubular member 42 within the tubular member 40, and then the bolt 44 can be tightened down upon the surface of the tubular member 42 to lock each stanchion 38 in place after they have been appropriately raised or lowered to the desired height.

As shown in FIGS. 1–4, a means to selectively raise and lower the netting material and netting support arms is slidably mounted on the bar 34 of the frame 20. The netting material and netting arm raising and lowering means includes an inverted, T-shaped handle 46 slidably mounted on the bar 34 for selective linear, reciprocable movement thereon. The opposed handle ends 48 of the handle 46 have rubber grips 50 for easy and comfortable gripping by the player during the raising and lowering of the handle 46. The handle 46 includes a slidable, hollow leg 52 which fits over and slides on the bar 34. The leg 52 must be able to smoothly and easily slide upward or downward on the bar 34. Also, the raising and lowering handle 46 includes a handle locking means for fixing the handle 46 in place on the frame 20 once the handle 46 has been raised or lowered to the appropriate position on the bar 34, and the handle locking means includes a spring plunger 54 aligned with an aperture (not shown) extending through the surface portion of the leg 52. In order to fix the handle 46 in position on the bar 34, and, by extension on the frame 20, the player pulls the spring plunger 54 rearward and grabs both ends 48 and then raises the entire handle 46 until the spring plunger 54 aligns with one of the apertures 36 of the bar 34. When the player has raised the handle 46 to the appropriate height, the spring plunger 54 releases and extends through the aperture of the leg 52 into and through one of the apertures 36 on the bar 34, thus fixing the handle 46 in position. In addition, the handle 46 can also include a second leg (not shown) secured to and aligned parallel with the leg 52, and the second leg would slide on the second handle tracking bar in conjunction with the slidable movement of the handle 46 on the bar 34. The second leg and second handle tracking bar would be used as additional support for maintaining the vertical alignment of the handle 46 on the frame 20. Thus, the handle 46 moves with the slidable movement of the frame 20, but, as above described, the handle 46 can be positioned and repositioned at various points along the bar 34 independent of the movement of the frame 20. This allows the practicing players to achieve a more precise height adjustment for the device 10 with respect to the basketball backboard and rim. Secured to the mid-portion of each tubular member 22 is a wear strip 56, and attached by a flexible cord to the middle horizontal bar 30 are a pair of wedges 58, the function of which will be hereinafter described.

Figure 3:
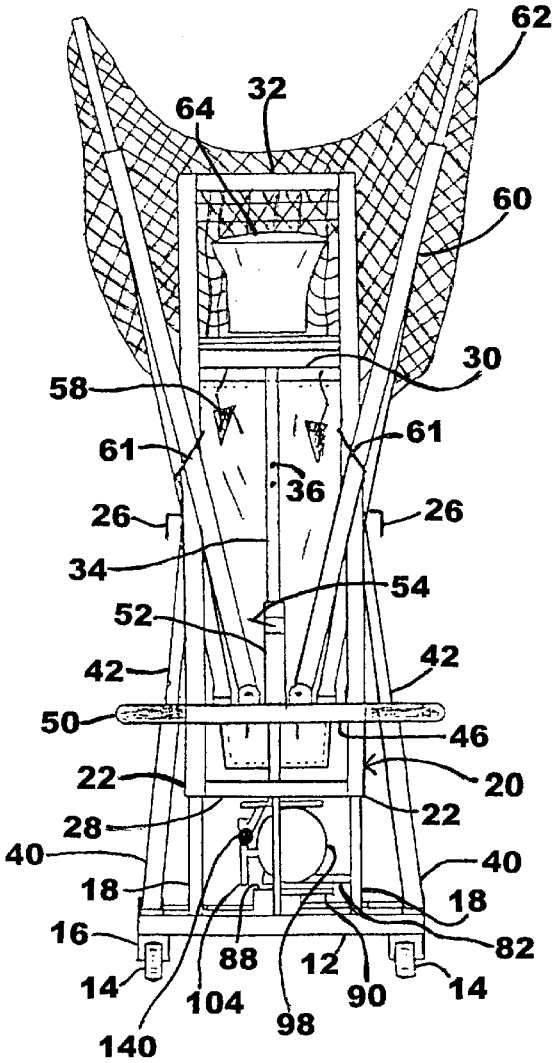
FIG. 3 is a rear elevational view of the device first shown in FIG. 2 wherein the device is shown in its initial set-up position.

Illustrated in FIGS. 1–4 and 9 are a plurality of extensible and retractable netting support arms 60. For the present invention, four independently-movable arms 60 are pivotably mounted to the handle 46, with two arms 60 pivotably secured to the handle 46 to the left of the leg 52, when viewing the device from the rear as shown in FIGS. 2–4, and the other two arms 60 pivotably secured to the right of the leg 52. The pivotable movement of the arms 60 is necessary to achieve a maximum extension of the arms 60 around and about the basketball backboard and rim, whether pole-supported or wall-supported. Thus, the two arms 60 secured closest to the leg 52 pivot on a horizontal axis, but in the same vertical plane as the handle 46, and thereby extend laterally and to the sides of the basketball backboard and frame 20. The two remaining arms 60 extend between each respective tubular member 22 and the bar 34 and, thus, project forwardly and in front of the frame 20 and basketball backboard and rim. The arms 60 pivot to the use position concomitant with the raising of the handle 46, as shown in FIGS. 2–4. The arms 60 also pivot concomitant with the lowering of the handle 46 so that the arms 60 can be brought to the non-use position during periods of device storage, as shown in FIG. 2. Thus, the arms 60 move upward or downward in conjunction with the movement of both the frame 20 and the handle 46; but the arms 60 pivot to their appropriate disposition coincident with the raising or lowering of the handle 46. This action can be independent of the upward or downward slidable movement of the frame 20. One arm catch 61 is secured at an angle to each tubular member 22 and both catches 61 serve as a guide for the two inboard arms 60 as well as limiting their lateral and pivotable range of motion.

As illustrated in FIGS. 1–4 and 9, a flexible netting material 62 is attached to the upper portions of each arm 60 and encompasses the basketball backboard and rim when the arms 60 are fully extended. The netting material 62 also collapses with the retraction of the arms 60 when the handle 46 is lowered, as shown in FIGS. 2 and 3. The netting material 62 collects errantly shot basketballs as well as basketballs that ricochet off the basketball backboard and rim, and also basketballs that fall through the rim. The netting material 62 directs the basketballs to a cylindrical basketball funnel member 64 which is attached to and communicates with the opening formed at the lowest point of the netting material 62. The position of the funnel member 64 is maintained by a plurality of horizontally-extending funnel support bars 66 which are attached to the tubular members 22 of the frame 20 adjacent the upper end of the frame 20. The funnel support bars 66 extend outwardly therefrom toward the front of the platform 12 so that the distal ends of the funnel support bars 66 can be secured to the funnel member 64 thereby maintaining the alignment of the funnel member 64 with the opening of the netting material 62. The funnel member 64 does not collapse but maintains its position as the netting material 62 simply collapses around the funnel member 64 as shown in FIGS. 2 and 3.

Figure 7:
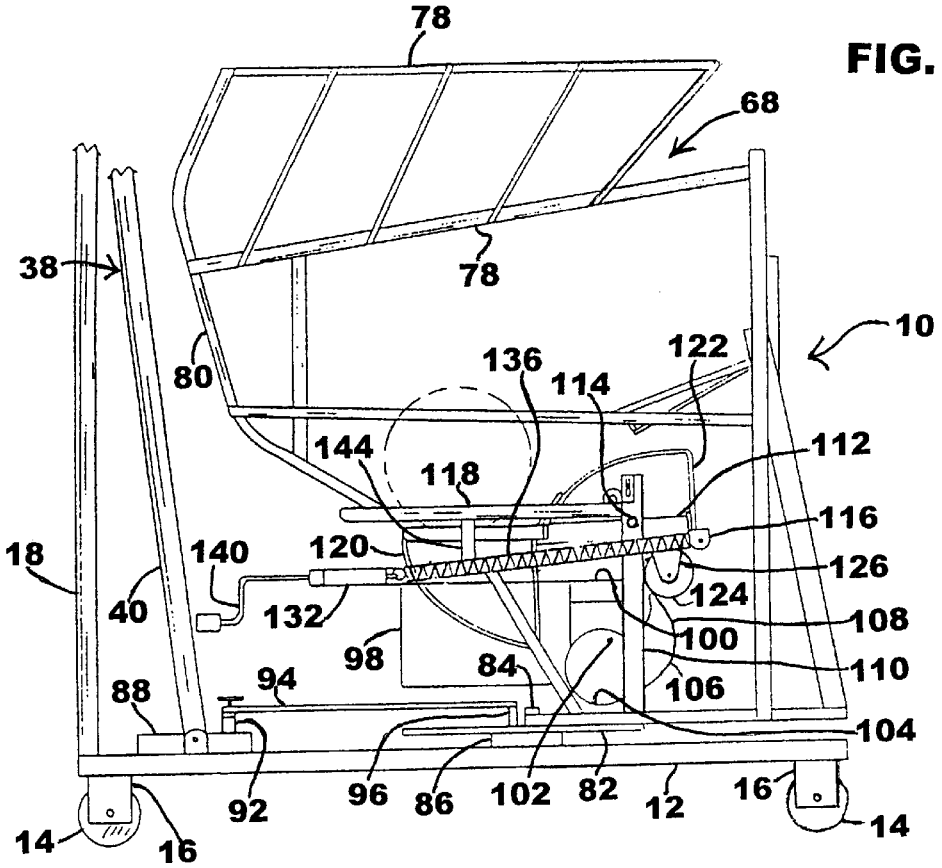
FIG. 7 is a side elevational view of the device first shown in FIG. 6, illustrating one basketball seated on the seating ring of the catapult arm, which is in the cocked or ready-to-throw position.
Figure 6:
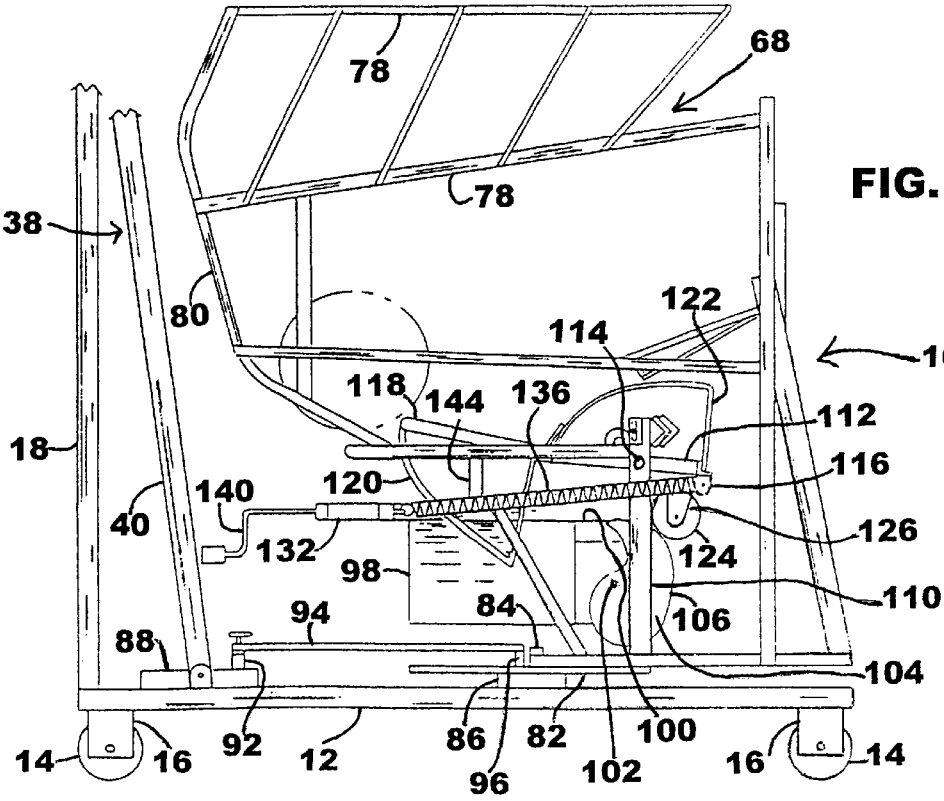
FIG. 6 is a side elevational view of the device first shown in FIG. 1, illustrating a single basketball rolling down the basketball guideway just prior to being received on the seating ring of the catapult arm.
Figure 9:
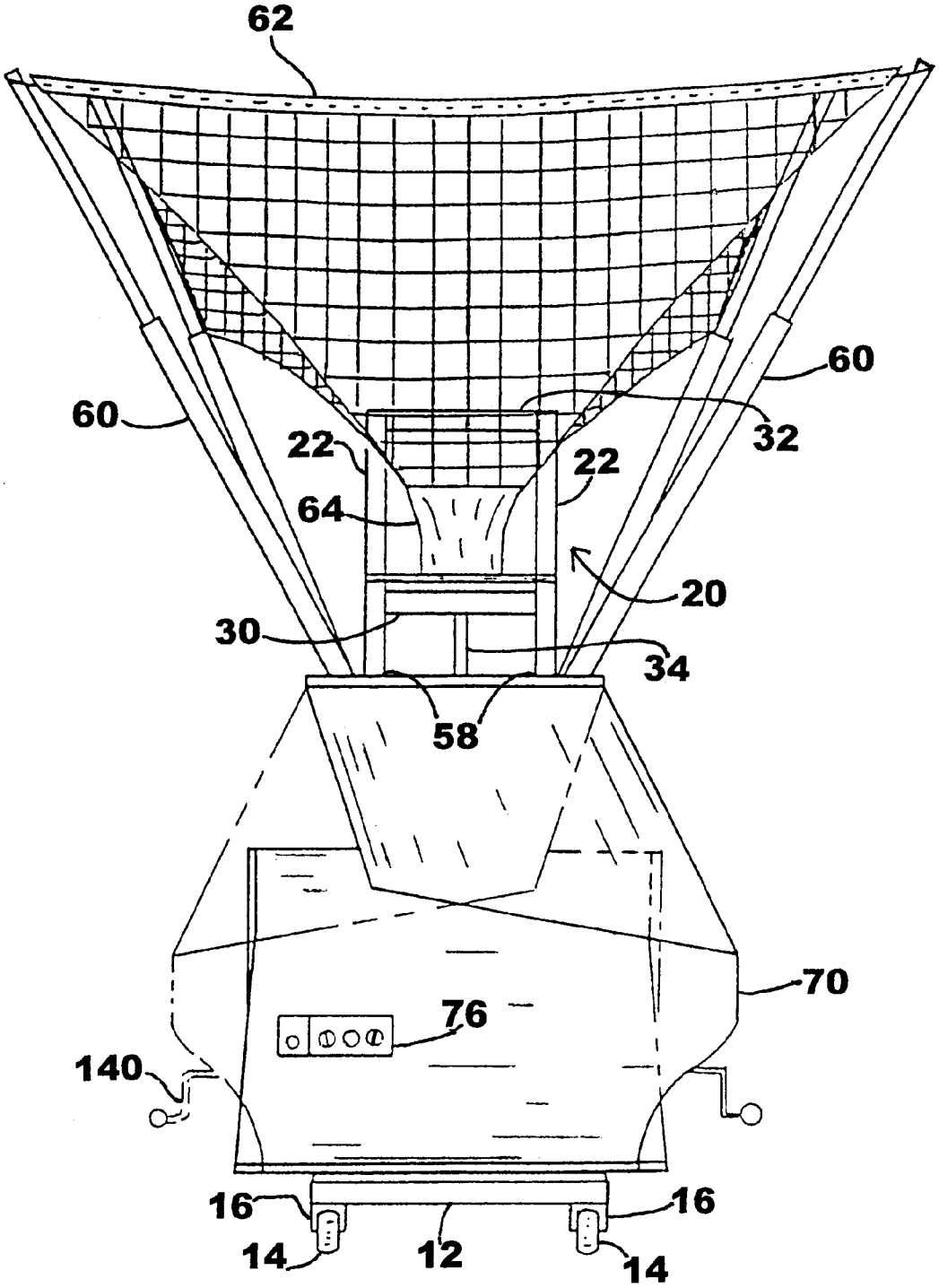
FIG. 9 is a front elevational view of the device which illustrates the range of pivotable movement of the basketball distribution and positioner plate and the cover which is mounted to the support platform and which protectively covers the mechanical elements of the device.

Illustrated in FIGS. 6–8 is a covering support framework 68 which is mounted to the platform 12 adjacent to the front thereof and which extends upwardly therefrom and also rearwardly towards the stanchions 38 and frame 20. The framework 68 supports a plastic shroud or covering 70 which protects mechanical and electrical elements (hereinafter further described) from player interference and injury and also provides an aesthetic feature. The covering 70 also includes an upper opening 72 which registers with the funnel member 64 and the opening at the lowest portion of the netting material 62 to allow basketballs to fall therethrough for throwing by the device 10. An ejection aperture 74, which is generally disposed at a right angle to the upper opening 72, is the aperture through which basketballs are ejected for return to the practicing players. In addition, a control panel 76, the function of which will be hereinafter described, is mounted on one side of the covering 70 and is manually operable by the players and is used for player control and selection of various features of the device 10.

The framework 68 comprises a plurality of angled, vertical and horizontally-extending tubes or bars 78 which support a basketball guide means for receiving basketballs that fall through the funnel member 64 and opening 72 of the covering 70 for guiding those basketballs to the mechanical elements that actually throw the basketballs. The basketball guide means includes a pair of angled or downwardly-sloping basketball guide bars 80 located at the rear of the framework 68 and which receive basketballs that fall through the opening 72 for directing basketballs downwardly therealong to mechanical throwing elements hereinafter further described.

The device of the present invention utilizes a variable basketball distribution means for ejecting a succession of shot basketballs to practicing players in the following three ways: (1) ejection of basketballs to the same place or point on the throwing playing surface; (2) ejection of the basketballs at various player-selected points within a 180° arc or semicircle traced out by the back-and-forth pivotable movement of the variable basketball distribution means; and (3) continuous ejection of shot basketballs throughout, and at all points along, the 180° arc or semicircle traced out by the back-and-forth fanning movement of the variable basketball distribution means with the rate of basketball ejection determined by the player-selected timer setting. The variable basketball distribution means includes a basketball distribution and positioner plate 82 which is spaced slightly above and parallel to the platform 12 and is located toward the front of the platform 12. The plate 82 is pivotable on a vertical axis within a 180° arc or semicircle whereupon the plate pivots laterally from one side of the platform 12 to the opposite side, and then back. As shown in FIGS. 6–8, the plate 82 is mounted to a vertically-extending rotatable shaft 84 which extends upwardly from a bearing housing 86. The housing 86 is mounted to the underside of the platform 12 and includes swivel bearings (not shown) which allow the shaft 84 to rotate on the plate 82. It should be noted that the framework 68, the covering 70, the guide bars 80, and the mechanical and electrical elements which collect and throw the succession of shot basketballs at timed intervals and in the aforedescribed distributions about the playing surface are all mounted to the plate 82 and, therefore, pivot throughout the same arc or semicircle as a result of the pivotable movement of the plate 82.

Figure 10:
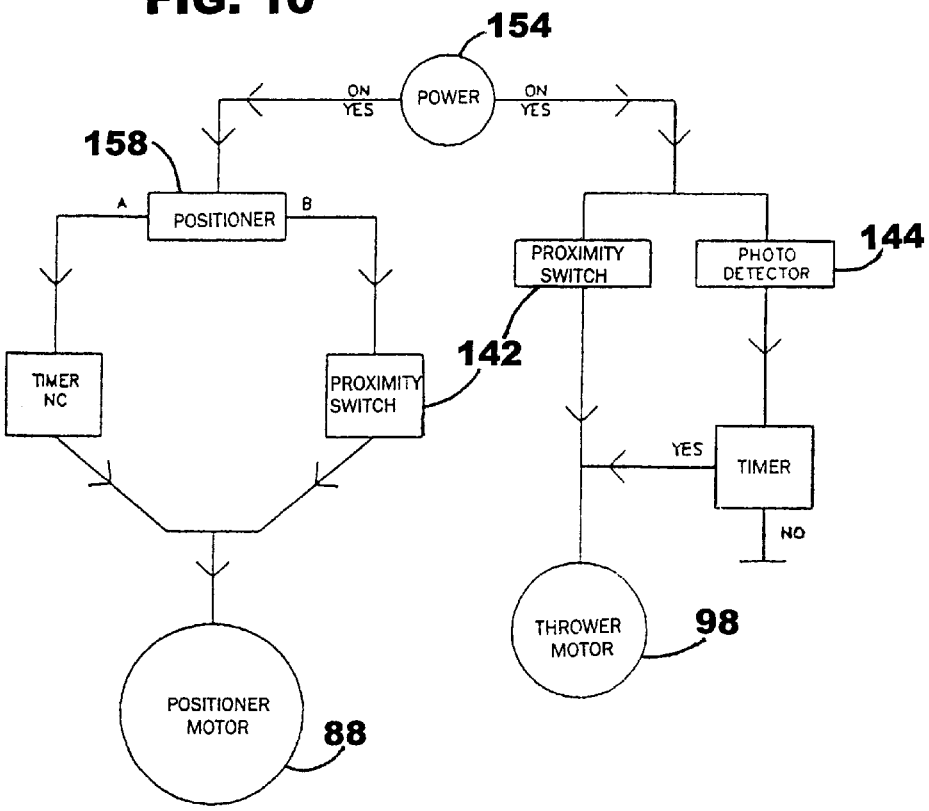
FIG. 10 is a flowchart showing the electrical and mechanical steps that occur when the device is set to the different throwing positions.
Figure 11:
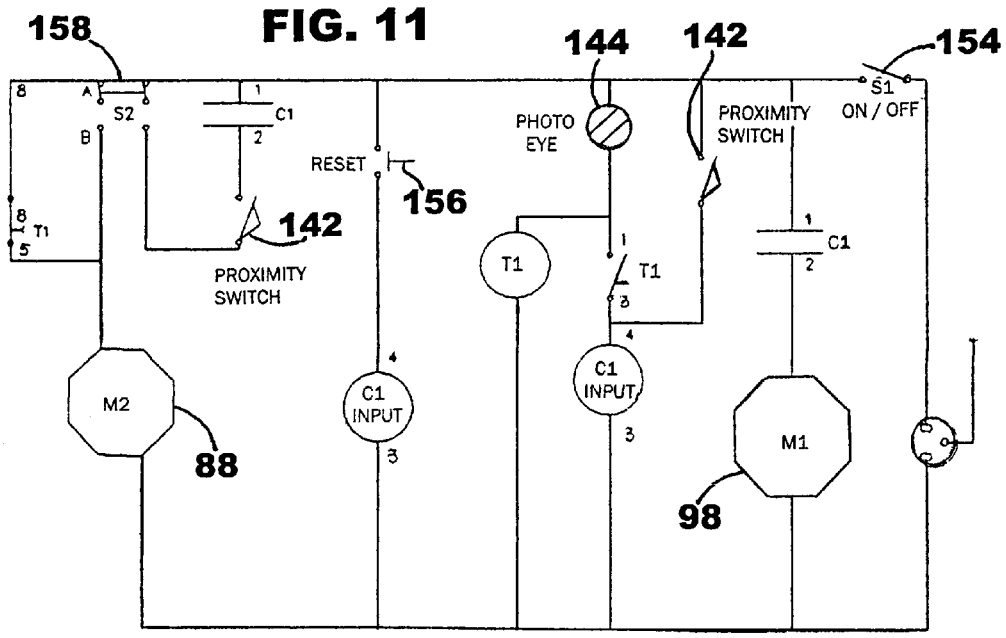
FIG. 11 is an electrical schematic diagram illustrates the processes that actuate and control the reception, loading, throwing, and reloading of the device for receiving and ejecting a succession of basketballs to players.

As shown in FIGS. 2–4, 6–8, and 14–18, a positioner motor 88 is mounted to the platform 12 toward the rear of the platform 12. The motor 88 transmits pivotable motion to the plate 82 by way of a linkage means which includes a first linkage arm 90 having one end drivingly connected to the motor 88 through a positioner motor shaft 92. The linkage means also includes a second linkage arm 94 having one end attached to the distal end of the first linkage arm 90 and a second end pivotably secured to a positioner plate shaft 96. The shaft 96 is mounted offset or eccentric to the vertical axis defined by shaft 84 so that the motor 88 can transmit a rotary motion that ranges between zero and 180° through the linkage arms 90 and 94. As shown in FIGS. 10 and 11, the motor 88 operates in conjunction with other electrical and mechanical elements of the device 10 to selectively pivot the plate 82 so that the ejection of the basketballs can be dispersed throughout the playing surface if the players so desire, and the motor 88 can also be shut down or disposed to the OFF position when ejection of the basketballs to one designated point on the playing surface is desired.

In order to transmit the power to the mechanical elements which physically throw the basketballs, a basketball ejection means is used and comprises a main thrower motor 98, hereinafter designated thrower motor (M1), which is mounted to the platform 12 and rotates concomitant therewith. The motor 98 does not need to be large horsepower motor and is preferably between a one and a ten horsepower motor. The motor 98 also includes a gear box 100 and a main drive shaft 102 which projects lateral to the motor 98. The drive shaft 102 is drivingly and eccentrically connected to a cam 104 which is thereby selectively rotatable. The cam 104 includes a bulging portion 106 and a fin-like cam lobe 108. A slot (not shown) is cut into the plate 82 so that free rotation of the cam 104 can occur.

Illustrated in FIGS. 5–8 is a basketball thrower means which is also mounted to the plate 82 and rotates concomitant therewith, and is disposed beneath the netting material 62 and between the framework 68 for enclosure by the covering 70. The basketball thrower means physically receives basketballs that drop through the opening of the netting material 62 and then through the opening 72 of the covering 70 in order to successively throw basketballs through the ejection aperture 74 and to the practicing players. The basketball thrower means includes a pair of catapult arm uprights 110 that are secured to the plate 82 and extending upwardly therefrom. The cam 104 rotates between the uprights 110. As shown in FIGS. 5–8, a T-shaped catapult arm 112 is pivotably mounted to the uprights 110 by means of a pivot pin or bolt 114 which extends through both uprights 110 and the arm 112. The arm 112 also includes a front crosspiece 116 which extends transverse to the arm 112 and pivots therewith. The crosspiece 116 does not interfere with the pivotal movement of the arm 112, as illustrated in FIGS. 5–8. The arm 112 also includes several unique features for receiving and seating one basketball while preventing the further downward movement along the guide bars 80 of other basketballs until the arm 112 is reloaded and cocked for the next throw. Among these elements is a seating ring 118 upon which the basketball to be thrown is received prior to its ejection from the device 10. In addition, at the forward end of the arm 112 is a curvilinear ball restraining member 120 that halts the downward movement of the basketball after it is received on the seating ring 118 so that the basketball does not proceed any farther forward on the arm 112. Also, the arm 112 includes a ball stop member 122 which prevents the next basketball from rolling forward on the guide bars 80 underneath the arm 112 after the arm 112 has pivoted to the throwing position to eject a basketball as shown in FIG. 8, whereupon the basketball would block the arm 112 from being recocked. Mounted to the underside of the arm 112 adjacent the crosspiece 116 is a wheel 124. The wheel 124 is directly contacted by the cam 104 and rotates as a result of the rotation of the cam 104.

Illustrated in FIGS. 5–8 is a catapult arm loading and releasing means which applies tension to the arm 112 for facilitating the throwing action. The catapult arm loading and releasing means is selectively adjustable in order to vary the amount of tension applied on the arm 112 so that the distance and velocity the basketballs are thrown can vary dependent upon the type of the practice session or drill being undertaken. The catapult arm loading and releasing means includes a rectangular-shaped framework 126 which is horizontally disposed above the motor 98 and immediately beneath the arm 112. The framework 126 includes two spaced-apart, tubular mainframe bars 128 which are horizontally disposed and have one end attached to the uprights 110. The mainframe bars 128 are cantilevered at their opposite ends, and each mainframe bar 128 receives a tension adjustment bar 130 for slidable, telescoping movement therein. A U-shaped end bar 132 is attached to both adjustment bars 130 at its mid-portion. A frame support bar 134 extends across and is attached at the distal ends of both mainframe bars 128, and the support bar 134 includes a centrally-located threaded aperture (not shown). A pair of helical tension springs 136 are used to both load and apply variable amounts of spring tension to the arm 112 in order to provide the force which causes the arm 112 to throw the basketballs. Each tension spring 136 is attached to opposite ends of the crosspiece 116 and the projecting ends of the end bar 132, and, for the safety of the players, each spring 136 is enclosed within a cylindrical plastic sheath. The end bar 132 also includes a centrally-located threaded aperture (not shown) aligned with the aperture of the support bar 134. Inserted for linear reciprocable movement through both apertures is an elongated screw thread 138 which terminates at a manually-operable screw adjustment handle 140. The handle 140 is used to selectively adjust or vary the tension applied by both springs 136 to the arm 112 in order to alter the distance and velocity by which the basketballs are thrown. Manually rotating the handle 140 clockwise draws the end bar 132 rearward and causes the adjustment bars 130 to telescope outward, thus stretching both springs 136 thereby increasing the load on the springs 136 and the force by which the arm 112 pivots for throwing basketballs. The arm 112 will throw basketballs with greater distance and velocity the more the springs 136 are stretched and the tension thereon is increased. Manually rotating the handle 140 counterclockwise, on the other hand, draws the end bar 132 toward the crosspiece 116 and causes the adjustment bars 130 to telescope within the respective mainframe bars 128, thus reducing the load on the springs 136. This adjustment reduces or lessens the distance and velocity by which the catapult arm 112 throws the basketballs.

As illustrated in FIGS. 5, 10, 11, and 13, the device 10 uses two proximity switches 142 with one proximity switch 142 used for shutting off the positioner motor 88 (herein designated M2), and the other proximity switch 142 is used for shutting off the main thrower motor 98 (M1). In addition, the device 10 utilizes a sensing and activation means for initiating the electrical and mechanical steps for receiving, loading, throwing, and then recocking the arm 112, and, in the present invention, the sensing and activation means is a single photoelectric eye 144 which is mounted by a bracket 146 to one of the non-movable mainframe bars 128. The eye 144 is located beneath and slightly off-center of the seating ring 118 when the arm 112 is disposed in the cocked or ready-to-throw position and generally level to the playing surface on which the device 10 is stationed. The eye 144 registers when one basketball is received on the seating ring 118 and also when the basketball leaves the seating ring 118 during the throwing process whereby the eye 144 generates electrical signals which initiate further electrical processes and mechanical actions as shown in the schematic of FIG. 10 and the flowchart of FIG. 11. The flowchart of FIG. 11 and the electrical schematic of FIG. 10 are readily familiar to anyone possessing knowledge of computer flowcharting and the ability to read electrical schematics.

With an individual standing in front of the 10 device so that the individual faces the ejection aperture 74 of the covering 70, a reference frame is defined whereby the proximity switches 142 can be more specifically denoted as a left proximity switch and a right proximity switch. Thus, the left proximity switch controls the motor 88 (M2) and the right proximity switch controls the motor 98 (M1). Both switches 142 are mounted to slidable brackets 148, each having an elongated slot 150 for permitting upward or downward adjustment of the switches 142. Located at the upper end of each upright 110 is a receiving hole (not shown) and each bracket 148 is affixed to the respective upright 110 by inserting a nut and bolt arrangement through the respective receiving holes and the slots 150. It is a simple matter to upwardly or downwardly adjust the location of each switch 142 by simply loosening the nut and bolt arrangement, sliding the bracket 148 upward or downward within the slot 150 until the appropriate position is reached, and then tightening the nut and bolt arrangement so that the bracket 148 and switch 142 are fixed in position on the respective upright 110. Raising or lowering the left hand switch 142 on the uprights 110 increases or decreases the number of preset positions the basketballs are ejected from throughout the 180° pivotable movement of the positioner plate 82. Selectively raising or lowering the left hand switch 142 brings the switch 142 closer to or farther away from the pivot point of the catapult arm 112, thereby altering the magnetic field strength between the switch 142 and the arm 112 which, as a consequence, varies the electrical signal strength and frequency. The switches 142 and the eye 144 are electrically connected to the manually-operable control panel 76 as shown in the electrical schematic of FIG. 11, and the control panel 76 includes a timer adjustment knob 152 which, for the present invention, allows practicing players to set the time intervals within which successive basketballs are ejected at half-second intervals up to five seconds. Also, the control panel 76 includes a power OFF/ON button 154, a reset button 156, and a throw position dial 158 having three settings so that basketballs can be ejected at pre-selected points about the 180° fanning range of the plate 82 (Setting A); the device 10 is positioned on the playing surface so that the ejection aperture 74 faces the same point on the playing surface and continually ejects balls at that point whereupon the plate 82 does not rotate or fan (the OFF position); and the device 10 continuously fans back and forth throughout the 180° arc or semicircle ejecting balls within the selected time interval to various points on the playing surface dependent only on how fast the players take shots and how quickly the basketballs are cycled through the mechanical elements of the basketball ejection means and the basketball thrower means (Setting B).

FIGS. 14–18 schematically illustrate the rotation of the plate 82 by the motor 88 and the linkage arms 90 and 94 when the dial 158 is set at Setting A. Starting with FIG. 14, the covering 70 is shown pointing laterally and at 90° from the longitudinal axis of the platform 12. If the device 10 in FIG. 14 was placed beneath a basketball backboard and rim and on the baseline with the device 10 pointing toward the tip-off circle, then, in FIG. 14, the covering 70 would be facing the point where the baseline and the out-of-bounds line meet, and the covering 70 would be parallel with that respective baseline. FIGS. 15–18 show in succession the pivoting of the covering 70 by the motor 88, the linkage arms 90 and 94, and the plate 82 through four positions until the covering 70 is pointed at and parallel with the foul line and is aligned with the longitudinal axis of the platform 12, and, thus, has pivoted 90° from the initial position as shown in FIG. 14. The plate 82 would continue pivoting through the remaining 90°, and when the plate 82 reaches the position opposite and 180° from that of FIG. 14, the motor 88 and linkage arms 90 and 94 cause the plate 82 to retrace its motion back to the position of FIG. 14. It has been demonstrated that four practicing players can easily shoot 800 basketballs in one hour, with the device 10 set to any of the three positions, without interruption or machine failure.

With reference to FIGS. 6–8, 10, and 11, the operation of the device 10 when the throw position switch is set to each of the three positions—A, OFF, or B—will now be described.

Mode I Operation

In this mode, the selector is set to "OFF" and the device only throws ball in the direction the basketball ejection aperture has already been pointed.

With the device 10 in the cocked or ready-to-throw state, a basketball is trapped by the netting material 62 and falls through the funnel member 64 whereupon the basketball is directed by the guide bars 80 to the seating ring 118 of the catapult arm 112. As the basketball is received by the seating ring 118, the basketball activates the photoelectric eye 144 which sends an electrical signal to activate the timer. The timer pauses for the pre-selected period of time which has been manually present by turning the knob 152 on the control panel 76 to the desired time increment. Timer increments are in half-second increments ranging from zero to five seconds for the present device but can be varied. An electrical signal (power) then goes to the relay (C1) which activates the motor 98 (M1). Activating the motor 98 (M1) causes the cam 104 to rotate in a clockwise direction by the drive shaft 102.

In the pre-selected period of time (in seconds) between the previous throw and the seating of the above-described basketball on the seating ring 118, a number of simultaneous mechanical actions have already occurred for returning the arm 112 to the cocked or ready-to-throw state.

At the end of the previous basketball throw, the arm 112 has been pivoted on the pivot pin 114 upward and away from the horizontal extension of the spring mounting and adjustment frame 126 between 45° and 90°. As the motor 98 (M1) rotates the cam 104 by the drive shaft 102, the initial rotation of the cam 104 does not bring the cam 104 in contact with the wheel 124 but, as the cam 104 continues its rotation, the bulging portion 106 contacts and rotates the wheel 124 in a counterclockwise direction. Continued rotation of the wheel 124 by the cam 104 causes the arm 112 to lower and return to the cocked or ready-to-throw position. As this is occurring, the wheel 124 pivots with the arm 112 so that, as the arm 112 returns to the ready-to-throw position, the wheel 124 is moved in a short arcuate path counterclockwise between and then forward of the uprights 110. In addition to and occurring simultaneous therewith, the springs 136 are stretched or extended between their attachment to the crosspiece 116 and the ends of the U-shaped end bar 132. The frame 126 is a stationary structure, but the crosspiece 116 pivots with the arm 112 on the pivot pin 114 concomitant with the motion of the arm 112 in returning to the ready-to-throw position, and it is this brief, quick, pivotable motion of the crosspiece 116, actuated by the rotation of the cam 104 against the wheel 124, that stretches and applies tension to the springs 136. With the motor 98 (M1) still in the ON state, the cam lobe 108 contacts, instantaneously rotates, and then passes by the wheel 124.

As a result, the basketball is lifted upward and thrown by the quick pivotable movement of the arm 112 immediately after the cam lobe 108 contacts and then rotates clockwise past the wheel 124 which causes the tension on the springs 136 to be released, and the basketball leaves the optical sensing range of the eye 144. The right side proximity switch 142 controls the motor 98 (M1) by generating electrical signals which either shut off or turn on the motor 98 (M1) as the device 10 goes through its entire throwing cycle. As the basketball leaves the optical range of the eye 144, the switch 142 assumes powering the relay (C1).

Throughout the aforedescribed process, the relay (C1) has maintained the electrical signaling to, and activation of, the motor 98 (M1). The motor 98 (M1) continues in the ON state, causing the cam 104 to continue rotating so that the above-described mechanical steps are repeated until the arm 112 is brought down level and out of range of the magnetic field of the right side proximity switch 142. Once the arm 112 has been pivoted by the action of the cam 104 and wheel 124 to the level position and out of range of the magnetic field of the switch 142, the motor 98 (M1) shuts off. Rotation of the cam 104 and wheel 124 has now caused the springs 136 to be stretched and tensioned and has returned the arm 112 to the initial ready-to-throw or cocked state. The device 10 is now ready to receive another basketball on the seating ring 118 for another throwing cycle.

Mode II Operation

In this mode, the selector switch is set to Position "A" so basketballs are thrown from a number of pre-set positions through a 180° arc.

With the device 10 in the cocked or ready-to-throw state, a basketball is trapped within the netting material 62 and falls through the funnel member 64 whereupon the basketball is directed by the guide bars 80 to the seating ring 118 of the catapult arm 112. As the basketball momentarily seats on the seating ring 118, the basketball immediately activates the photoelectric eye 144 which sends an electrical signal to activate the timer. The timer then pauses for the pre-selected period of time as set by the knob 152 on the control panel 76. Power is then transferred to the relay (C1) which activates the motor 98 (M1).

Between the previous throw and the return of the device 10 to the cocked state, the same mechanical processes that occur when the device 10 is set to the OFF position repeat when the device 10 is set to Setting A in order to return the arm 112 to the cocked state. The last step occurs when the cam lobe 108 passes the wheel 124 thereby releasing the wheel 124 so that the tension on the springs 136 is released, thereby causing the springs 136 to contract and pivot the arm 112 so that the arm 112 quickly moves upward in an arcuate path to throw the basketball.

As the basketball is lifted upward by the arm 112 and thrown through the ejection aperture 74, the basketball leaves the optical sensing range of the eye 144. At the moment this occurs, the right side proximity switch 142 assumes powering the relay (C1) which continues sending electrical signals to the motor 98 (M1). Simultaneous with the action of the right side switch 142, upward movement of the arm 112 past the left side switch 142 powers up the uncharged contact in the relay (C1). As a result, electrical signals are sent to and power the motor 88 (M2). On Setting A, the motor 88 (M2) causes the plate 82 to pivot in a 180° arc or semicircle back and forth in a constant fanning motion. The motor 88 (M2) causes the plate 82 to pivot or rotate in stages or steps between a number of predetermined positions, stopping briefly at each position to allow basketball ejection, and the positions may be separated by 5% to 45% from each other.

As previously described, continued clockwise rotation of the cam 104 rotates the wheel 124, draws the arm 112 down to the cocked or ready-to-throw state and thereby applies tension to the springs 136. As the arm 112 is lowered to the cocked or ready-to-throw state, the arm 112 passes by and then out of range of both the left side and the right side proximity switches 142. As a consequence, the contacts in the relay (C2) open up and, thus, power to the motor 98 (M1) and motor 88 (M2) is terminated for the pre-selected time period. The device 10 is now cocked and ready for another throwing cycle.

Mode III Operation

In this mode, the selector switch is set to Position "B", and the device continuously fans back and forth through a 180° semicircle for ejecting basketballs at a rate determined by the pre-set timer.

With the device 10 already in the cocked or ready-to-throw position whereby the catapult arm 112 is level with the spring mounting and adjustment frame 126, the springs 136 are under tension and loaded and the cam 104 has rotated so that the cam lobe 108 is contacting the wheel 124, a basketball is trapped by the netting material 62 and falls through the funnel member 65 whereupon the basketball is channeled along the guide bars 80 to the seating ring 118. As the basketball seats upon the seating ring 118, the basketball immediately activates the photoelectric eye 144 which then sends an electrical signal to activate the timer. The timer then pauses for the pre-selected period of time as determined by the setting of the knob 152, but power to the motor 88 (M2) is maintained during this pause for pivoting the plate 82. With the timer momentarily deactivated, motor 98 (M1) is energized and the cam lobe 108 rotates against the wheel 124. Then, as the cam lobe 108 passes by the wheel 124, the tension on the springs 136 is released and the arm 112 quickly pivots upward to throw the basketball. The left side proximity switch 142 maintains control and sends electrical signals through the relay (C1) to continue powering the motor 88 (M2) to pivot the plate 82. After the throw, the right side proximity switch 142 assumes powering the relay (C1) that energizes the motor 98 (M1) so that the arm 112 can be returned to the home position whereby the arm 112 is cocked for the next throwing cycle. Upon return to the home position, the arm 112 will be out of range of the right side proximity switch 142.

The right side proximity switch 142 powers relay (C1) so that electrical signals are sent to the motor 98 (M1) which stays on until the arm 112 returns to the home or cocked position. Upon return to the home position, the arm 112 will be out of range of the magnetic field of the right side proximity switch 142. Electrical signals will fall off and, as a result, power to the motor 98 (M1) will be terminated, thus temporarily shutting off the motor 98 (M1). However, the motor 88 (M2) will still be energized so that continued pivotable movement will be transmitted by motor 88 (M2) through the linkage arms 90 and 94 and to plate 82. The device 10 will be ready for the next throwing cycle while the plate 82 will continue to pivot or fan back and forth through the 180° arc.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A portable basketball retrieval and automatic return device for use on a playing surface, comprising:

a normally-stationary portable platform for disposition on the playing surface;

a substantially closed housing mounted to rotate on the platform and having a first opening facing generally upwardly for receiving successive basketballs therethrough, and a second opening facing generally outward from a side of the housing for the ejection of the successive basketballs in a trajectory over the playing surface;

means enclosed within the housing for diverting outwardly through the second opening the successive basketballs received through the first opening including a catapult arm mounted to pivot between a first cocked position and a second released position, and a rotatable cam operatively engaged to the catapult arm to cause the arm to pivot between the first cocked position and the second released position.

2. The device of claim 1 further comprising a first main thrower motor for rotating the cam and a second positioner motor mounted to the platform for selectively pivoting the housing.

3. The device of claim 2 further comprising a positioner plate mounted on the platform and capable of selective pivotable movement on a vertical axis with respect to the housing.

4. The device of claim 3 further comprising a linkage means operatively connected to the positioner motor and the positioner plate so that selective rotary motion can be transmitted by the positioner motor through the linkage means and to the positioner plate.

5. The device of claim 4 wherein the catapult arm includes a pair of catapult arm uprights mounted to the positioner plate and extending upwardly therefrom toward the first opening and on which the catapult arm pivots.

6. The device of claim 5 wherein the catapult arm includes a seating ring for receiving thereon one basketball at a time whereupon pivotable movement of the catapult arm from the cocked position to the released position causes the basketball to be ejected from the seating ring and thrown through the second opening.

7. The device of claim 6 wherein the positioner plate is capable of selective pivotable movement within an angular range between 0° and 180° relative to the platform.

8. For use in combination with a basketball backboard and rim, a portable basketball retrieval and automatic return device for disposition on a playing surface beneath the backboard and rim, comprising:

a support platform capable of being positioned and repositioned on the playing surface;

a housing mounted to the support platform for selective sequential and continuous back-and-forth pivotable movement on a vertical axis within a substantially wide angular range in order to eject basketballs therefrom coincident with the pivotable movement of the housing;

funneling means mounted to the platform for selective extension and retraction thereon so that the funneling means can be disposed about the basketball backboard and rim for collecting shot basketballs and directing the basketballs downwardly to the housing so that the basketballs can be ejected therefrom about the playing surface;

the housing having an upper opening for receiving basketballs from the funneling means and an ejection aperture through which the succession of basketballs are ejected to the practicing players; and the housing enclosing:

a basketball thrower means including a catapult arm disposed beneath the upper opening for successively receiving basketballs that fall through the upper opening, the catapult arm selectively pivotable between a cocked position and a released position in order to continuously throw basketballs through the ejection aperture;

variable basketball distribution means mounted to the platform for pivoting the housing within the predetermined angular range including a positioner plate pivotably mounted to the platform and to which the housing is secured, a positioner motor mounted to the platform, linkage means operatively engaging the motor to the positioner plate for transmitting selective pivotable motion to the positioner plate;

a basketball ejection means mounted to the positioner plate and including a main thrower motor, and a cam operatively engaged by the main thrower motor for selective unidirectional rotation to cock and release the catapult arm; and the basketball thrower means and the basketball ejection means both being mounted to the positioner plate so that the basketball thrower means and the basketball ejection means pivot concomitant with the pivotable motion of the housing.

9. The device of claim 8 further including spring means operatively connected to the catapult arm and responsive to rotation of the cam to apply a biasing force to urge the catapult arm toward the released position.

10. The device of claim 9 wherein the spring means includes a pair of spaced-apart springs that are selectively biased from a loaded position for cocking the catapult arm to a released position for pivoting the catapult arm to throw the basketball.

11. The device of claim 10 wherein the positioner plate is capable of selective pivotable movement throughout the angular range whereupon the positioner plate can momentarily stop at a series of predetermined positions to throw the basketball and then continue pivoting to the next position to throw the next basketball.

12. The device of claim 11 further comprising a means to selectively vary the number of sequential positions from which the basketballs can be thrown during pivotable movement of the housing throughout the angular range.

13. The device of claim 12 wherein the means to vary the number of sequential positions to throw the basketball includes at least one proximity switch mounted to the catapult arm upright adjacent the catapult arm and which is capable of selective upward and downward adjustment on the catapult arm with respect to the pivot point of the catapult arm.

* * * * *